US006474951B2

(12) United States Patent
Stephan et al.

(10) Patent No.: US 6,474,951 B2
(45) Date of Patent: Nov. 5, 2002

(54) CONTROLLER FOR PUMP AND VALVE

(75) Inventors: Waldemar Stephan, Dortmund (DE); Albert Genster, Marl (DE)

(73) Assignee: WILO GmbH, Dortmund (DE)

( * ) Notice: Subject to any disclaimer, the term of this patent is extended or adjusted under 35 U.S.C. 154(b) by 0 days.

(21) Appl. No.: 09/782,954

(22) Filed: Feb. 14, 2001

(65) Prior Publication Data

US 2001/0054395 A1 Dec. 27, 2001

(30) Foreign Application Priority Data

Feb. 16, 2000 (DE) ..... 100 07 088

(51) Int. Cl.[7] ..... F04B 49/00

(52) U.S. Cl. ..... 417/26; 417/44.1; 417/32; 417/23

(58) Field of Search ..... 417/26, 44.1, 32, 417/23; 340/635, 679

(56) References Cited

U.S. PATENT DOCUMENTS 3,525,875 A * 8/1970 Ziomek ..... 307/10.1
4,078,196 A * 3/1978 Thadani ..... 318/562
6,199,517 B1 * 3/2001 Genster et al. ..... 123/41.14
6,254,350 B1 * 7/2001 Koenig et al. ..... 417/36

FOREIGN PATENT DOCUMENTS

FR 239133 * 9/1987

* cited by examiner

*Primary Examiner*—Charles G. Freay
*Assistant Examiner*—Michael K. Gray
(74) *Attorney, Agent, or Firm*—Herbert Dubno

(57) ABSTRACT

The invention relates to an apparatus including a pump 1 driven by an electronically controlled electric motor 3 with a pump controller 4 and a valve 2 operated by an electronically controlled drive 10 with a valve controller 11, the valve controller 11 being partially or fully integrated in the pump controller 4.

8 Claims, 5 Drawing Sheets

CONTROLLER FOR PUMP AND VALVE

FIELD OF THE INVENTION

The invention relates to an apparatus including a pump driven by an electronically controlled electric motor with a pump controller and a valve operated by an electronically controlled drive with a valve controller.

BACKGROUND OF THE INVENTION

Such apparatuses are known for example in the motor-vehicle field. The valve is a multiple-position valve that can be driven by a linear or rotary drive, for example by a rotary solenoid, a stepping motor, or a direct-current motor. Independent of the type of drive mechanism of the valve there are position sensors that ensure an exact positioning of the valve body.

In these known apparatuses both the pump and the valve each have their own controllers that each include a power circuit, a processor, and a communication module. The two controllers are advantageously connectable by a data bus to a separate or superior controller.

German patent 4,335,403 describes a hydraulic device with two such controllers. This hydraulic device has a pump driven by an alternating-current motor that is controlled by an adjustment element. The rotation rate of the motor is thus set by a frequency controller that receives appropriate instructions from a master controller. In addition the hydraulic device has a valve that is controllable via a controller separate from that of the pump. Communication between the frequency controller of the motor of the pump on one hand and the controller of the valve on the other hand takes place via the master controller. In this hydraulic device no further communication with other outside components is provided.

For the case where both the controller of the pump and the controller of the valve must communicate with such external components, for example for remote control or setting of temperature parameters, valve settings, or to conduct diagnoses, both controllers need a communication module.

The two controllers thus require as a result of the respective communication modules substantial space and high cost, while the connection of the two controllers also is a complex installation and gives quite some room for error. In addition plugs or connectors as well as cables are needed in substantial quantities and various lengths.

OBJECT OF THE INVENTION

It is an object of the present invention to provide an apparatus of the above-mentioned type that is of simple and inexpensive construction and easy to use, that is of modest overall dimensions and light weight, and that is fast and easy to install and connect. It should only require a minimal number of connections and short connecting paths.

SUMMARY OF THE INVENTION

This object is achieved according to the invention by an apparatus as described wherein the valve controller is fully or partially integrated into the pump controller.

The main advantage is that at least some components of the valve controller can be eliminated. The functions of the eliminated components are taken over by those of the pump controller. This leads to a reduction of the space needed to install the valve or the valve controller and in particular to a reduces cost for installing and connecting the device. Possibilities of error are thus reduced to a minimum. It is also possible to make and install the device in this manner particularly inexpensively.

It is particularly advantageous when the valve controller is completely integrated in the pump controller.

It is further particularly advantageous when modules and/or components are provided in the pump controller that take over some or all the functions for valve control through the pump controller.

In a preferred embodiment of the invention the electric motor driving the pump has a power circuit, a processor, and a communication module for communicating with a separate master controller, and the drive mechanism driving the valve is connected via a communication module and in particular via a power circuit to the separate master controller, at least the communication module of the drive mechanism of the valve being integrated in the pump controller. The communication module is the largest part of the controller so this saves the greatest amount of the needed space.

It is particularly advantageous when the drive mechanism and in particular the power circuit of the valve is connected via the communication module of the pump controller to the separate master controller. In this manner only a single communication module is needed for both the pump and valve.

The space requirements of the valve can be reduced in that the drive mechanism of the valve is controlled via a processor that is integrated into the pump controller.

Here it is particularly advantageous when the power circuit of the drive mechanism of the valve is controlled by the processor of the pump controller. Thus only a single processor is needed for the pump and the valve.

The space requirement for the valve can further be reduced in that the power circuit of the drive mechanism of the valve is integrated in the pump controller.

In a particularly preferred embodiment the power circuit of the drive mechanism of the valve is controlled via an evaluating unit having at least one temperature sensor, at least one flow sensor or at least one pressure sensor for the liquid moved by the pump. The sensors can thus detect the temperature and/or the flow rate and/or the pressure of the pumped liquid.

It is further particularly advantageous when the valve is directly connected to or integrated into the pump. In this manner the expense of mounting and connecting the apparatus according to the invention is reduced to a minimum. Only a few plugs and in particular a few short cables are needed. The apparatus can be installed in the tightest spaces and made modular.

In a further particularly preferred embodiment the pump forms with the electric motor and the pump controller together with the valve and the drive mechanism as well if necessary with at least one sensor a module or unit that is connected via at least two hydraulic connections to a liquid-cooling system and via at least one electrical connection to the separate master controller.

The liquid-cooling system can be the coolant system for a combustion engine of a motor vehicle or the hot-water circuit of a heating system.

BRIEF DESCRIPTION OF THE DRAWING

Further advantages and features of the invention are given in the following description and in the embodiment shown in the drawing.

Therein.

Figure 1:
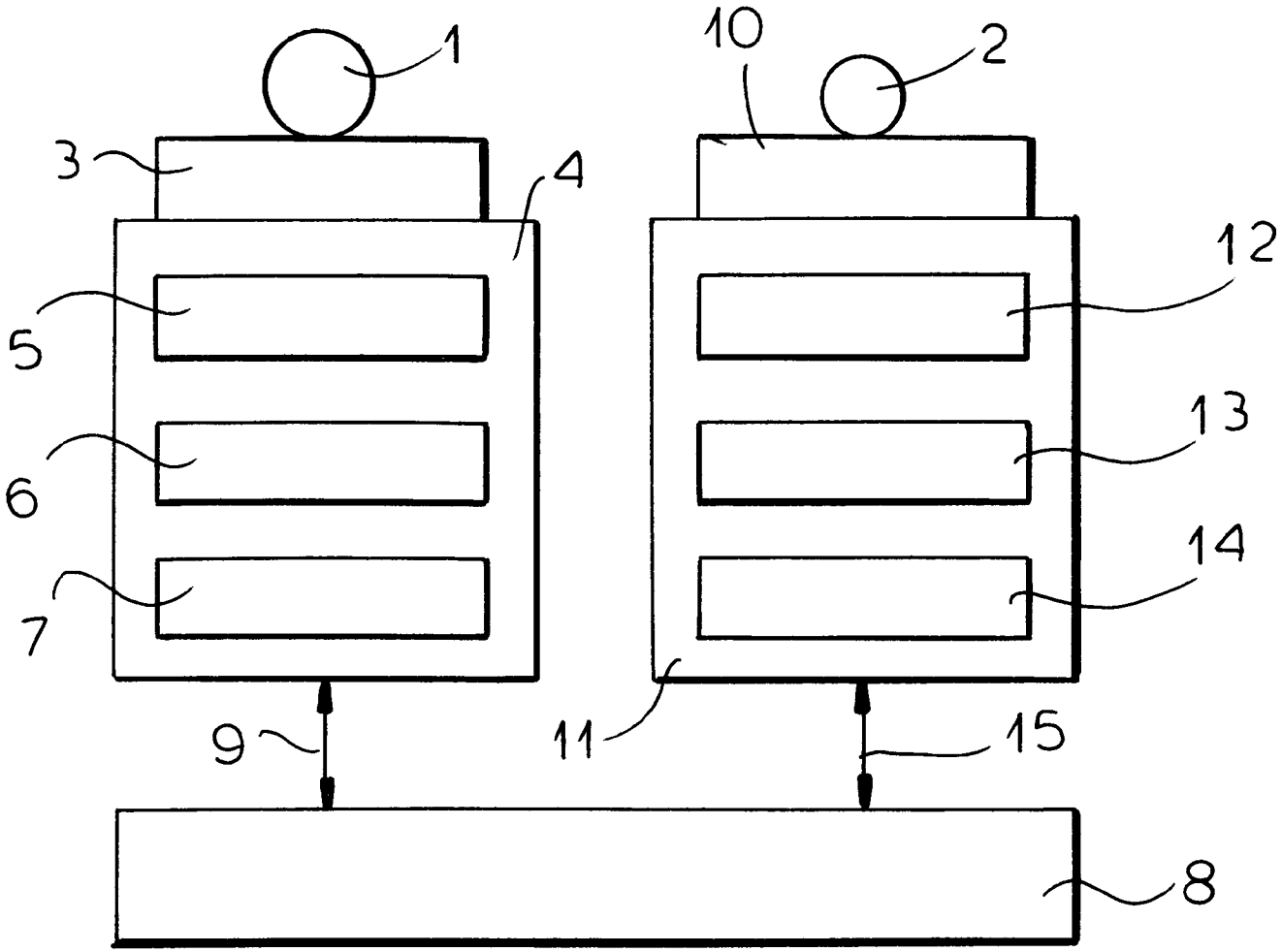
FIG. 1 is a schematic illustration of a standard apparatus according to the prior art.

The individual components of the apparatus shown as blocks in the drawings are referenced the same in all figures.

The illustration of FIG. 1 corresponds to the known apparatuses that have a pump 1 and a valve 2. The valve 2 is in the illustrated embodiment a three-way valve although the invention also can be used with another type of valve.

The pump 1 is driven by an electronically controlled electric motor 3 that is controlled by a pump controller 4. The pump controller 4 has a power circuit 5, a processor 6, and a communication module 7 for communicating with a separate master controller 8. A data bus 9 connects the pump controller 4 to the master controller 8.

The valve 2 is driven by an electronically controlled drive mechanism 10 that is controlled by a valve controller 11. The drive mechanism 10 is in the illustrated embodiment a stepping motor although other drives can be used.

In the known apparatuses according to FIG. 1 the valve controller 11 has a power circuit 12, a processor 13, and its own communication module 14 for communicating with the separate master controller 8. To this end the valve controller 11 is connected via a second data bus 15 to the master controller 8.

Figure 2:
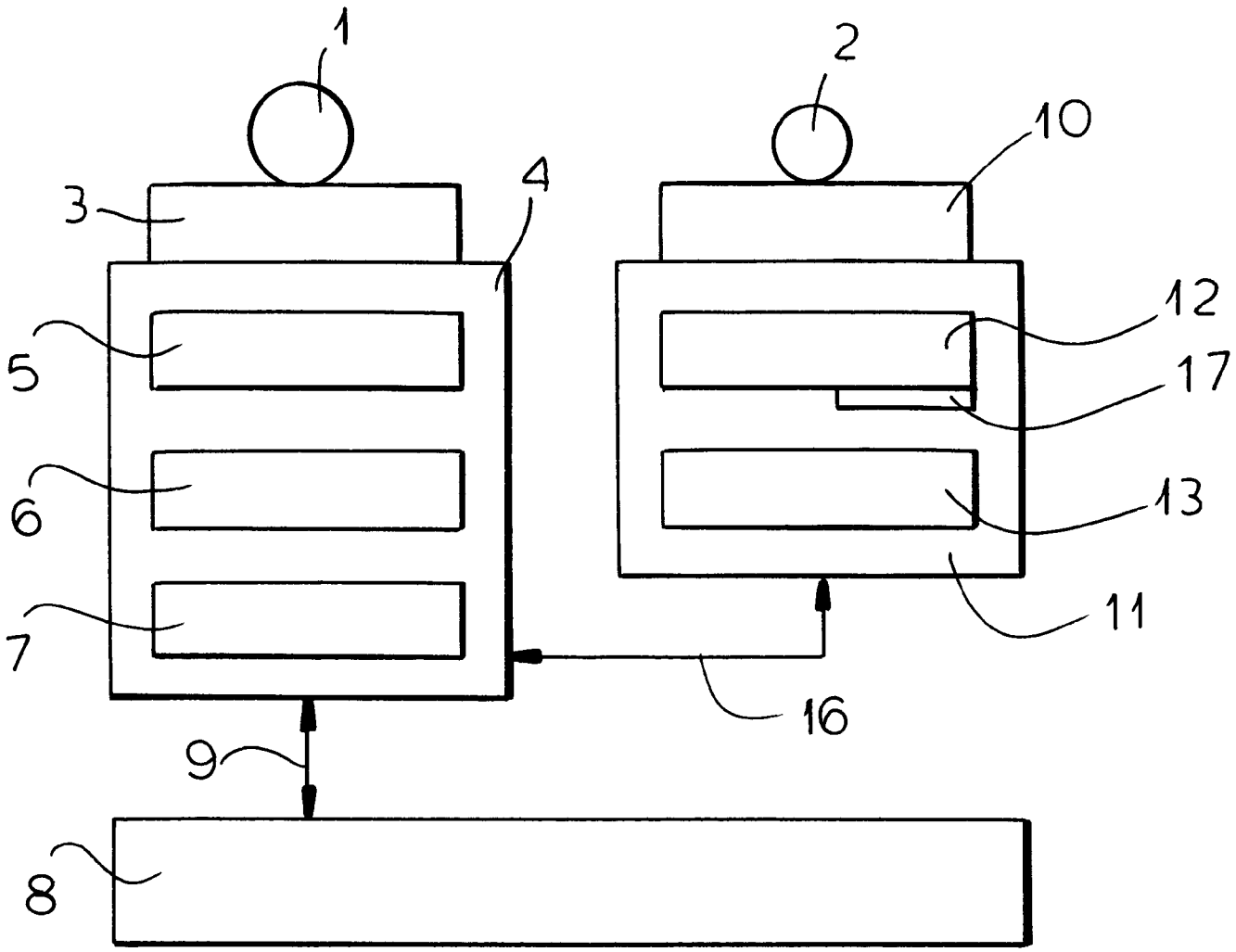
FIG. 2 is a schematic illustration of an apparatus according to the invention.
Figure 3:
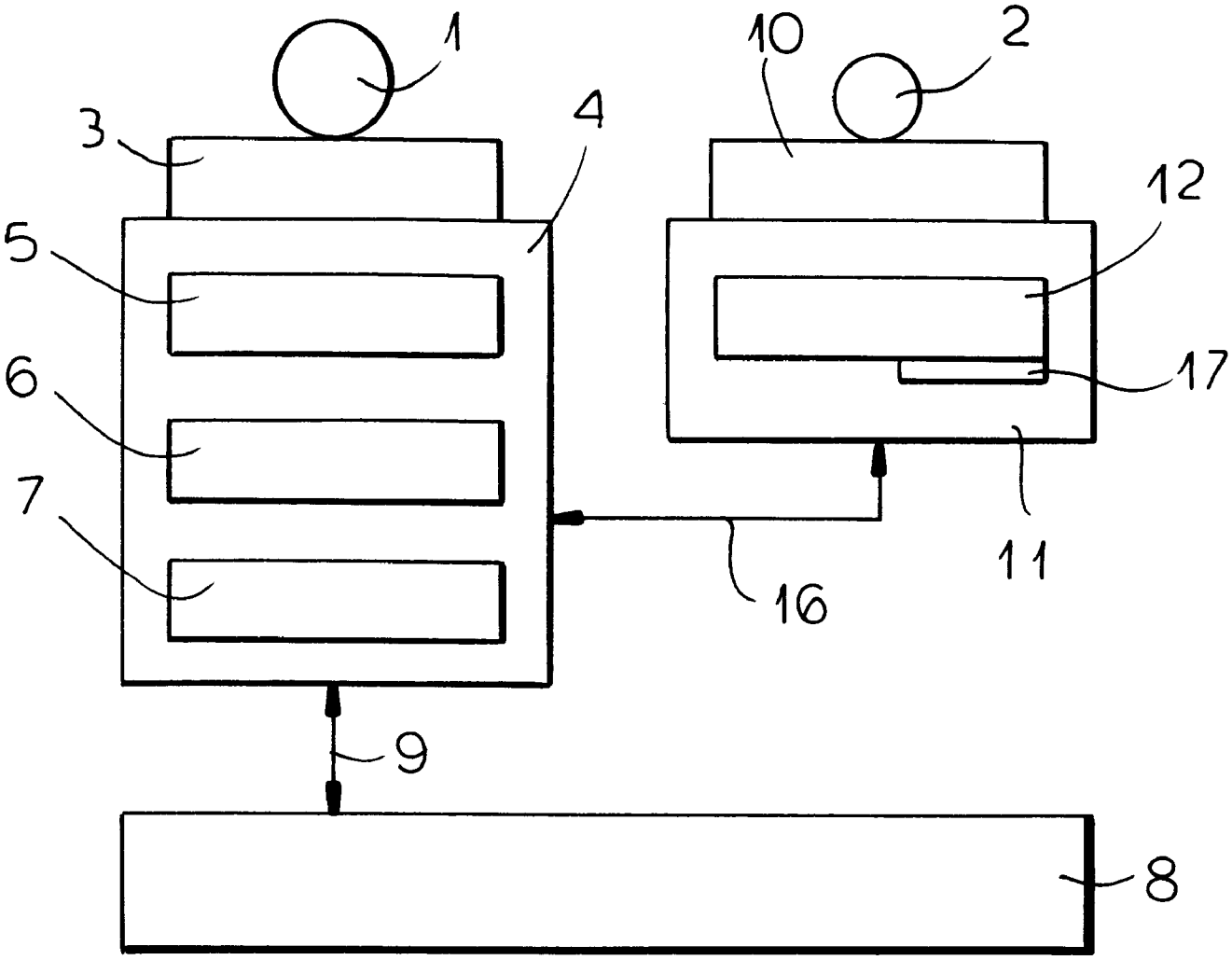
FIG. 3 is a schematic illustration of a variant on the apparatus according to the invention.
Figure 4:
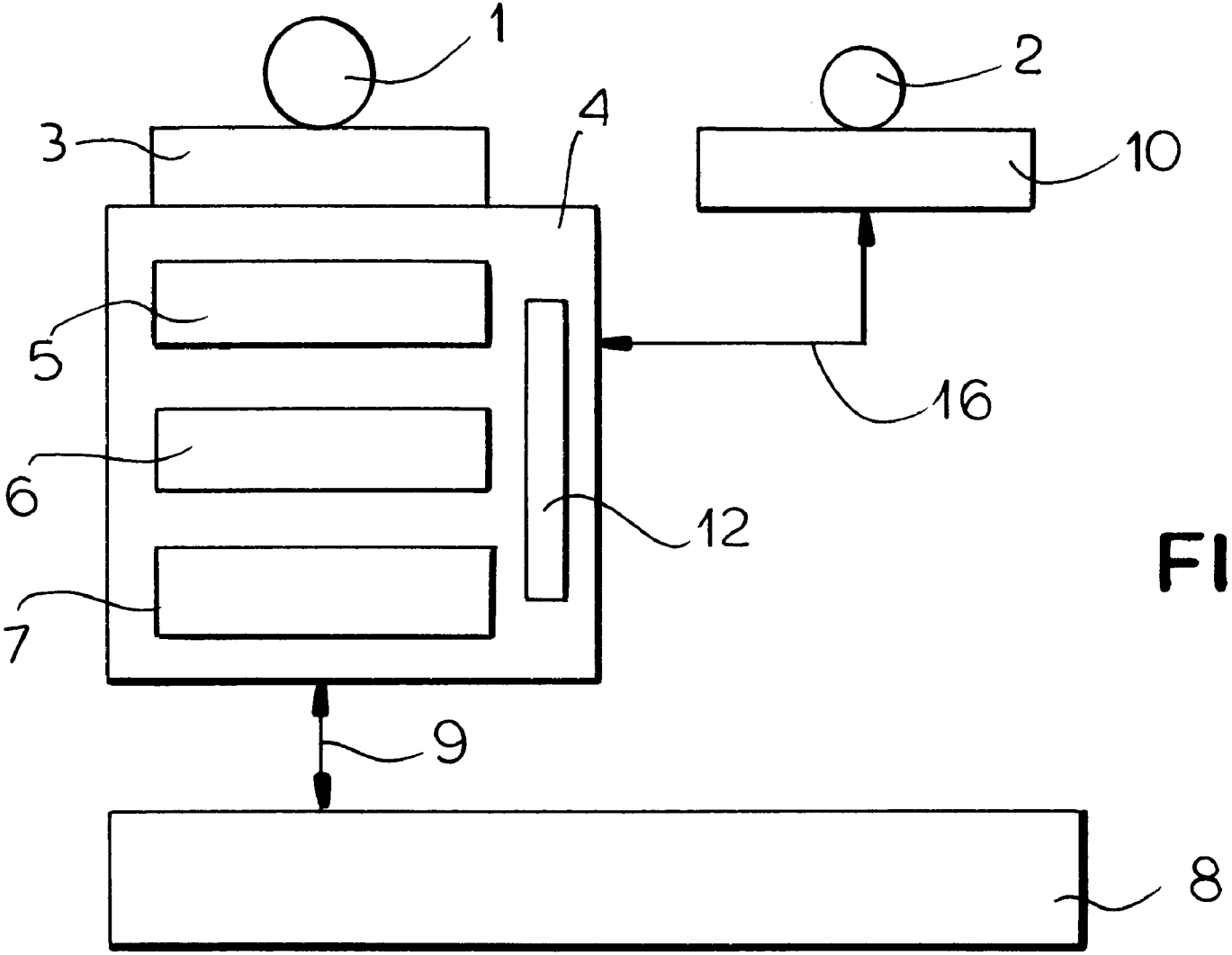
FIG. 4 is a schematic illustration of a further variant on the apparatus according to the invention.

In the embodiments according to the invention of FIGS. 2 through 4 at least the function of the communication module 14 of the valve controller 11 is integrated in the pump controller 4. The communication module 7 of the pump controller 4 thus takes care of communication for the pump controller 4 as well as communications between the valve controller 11 and the separate master controller 8. Only a single data bus 9 is needed for the communication, saving considerable costs. The drive mechanism 10 of the valve 2 (FIG. 4) as well if necessary as further provided components of the valve controller 11 (FIGS. 2 and 3) are only connected via a relatively simple and inexpensive control connection 16 to the pump controller 4.

In the embodiment of FIGS. 2 and 3 the power circuit 12 of the valve controller 11 has an evaluating unit 17 that determines via two sensors 18 the temperature of the liquid moved by the pump 1 and supplies them to the valve controller 1 to control the valve 2. In other embodiments sensors can also be provided to determine the flow rate and/or the pressure of the pumped liquid.

In the embodiment according to FIG. 2 the valve controller 11 has a power circuit 12 and a processor 13. In the embodiment of FIG. 3, however, the processor 13 is also integrated into the pump controller 4. The power circuit 12 of the valve controller 11 is controlled thus via the processor 6 of the pump controller 4 so that only a single processor 6 is needed to control both the pump 1 and the valve 2.

In the embodiment of FIG. 4 the space occupied by the valve 2 is reduced to a minimum in that the power circuit 12 of the valve controller 11 is integrated into the pump controller 4. Also here only one simple and inexpensive motor-connection cable 16 is needed for connecting the drive mechanism 10 of the pump 2 to the pump controller 4.

When the valve 2 is connected via hydraulic couplings and electrical plug connections directly to the pump 1 or when the valve is fully or at least partially integrated into the pump 1 the connection cable is not needed.

Figure 5:
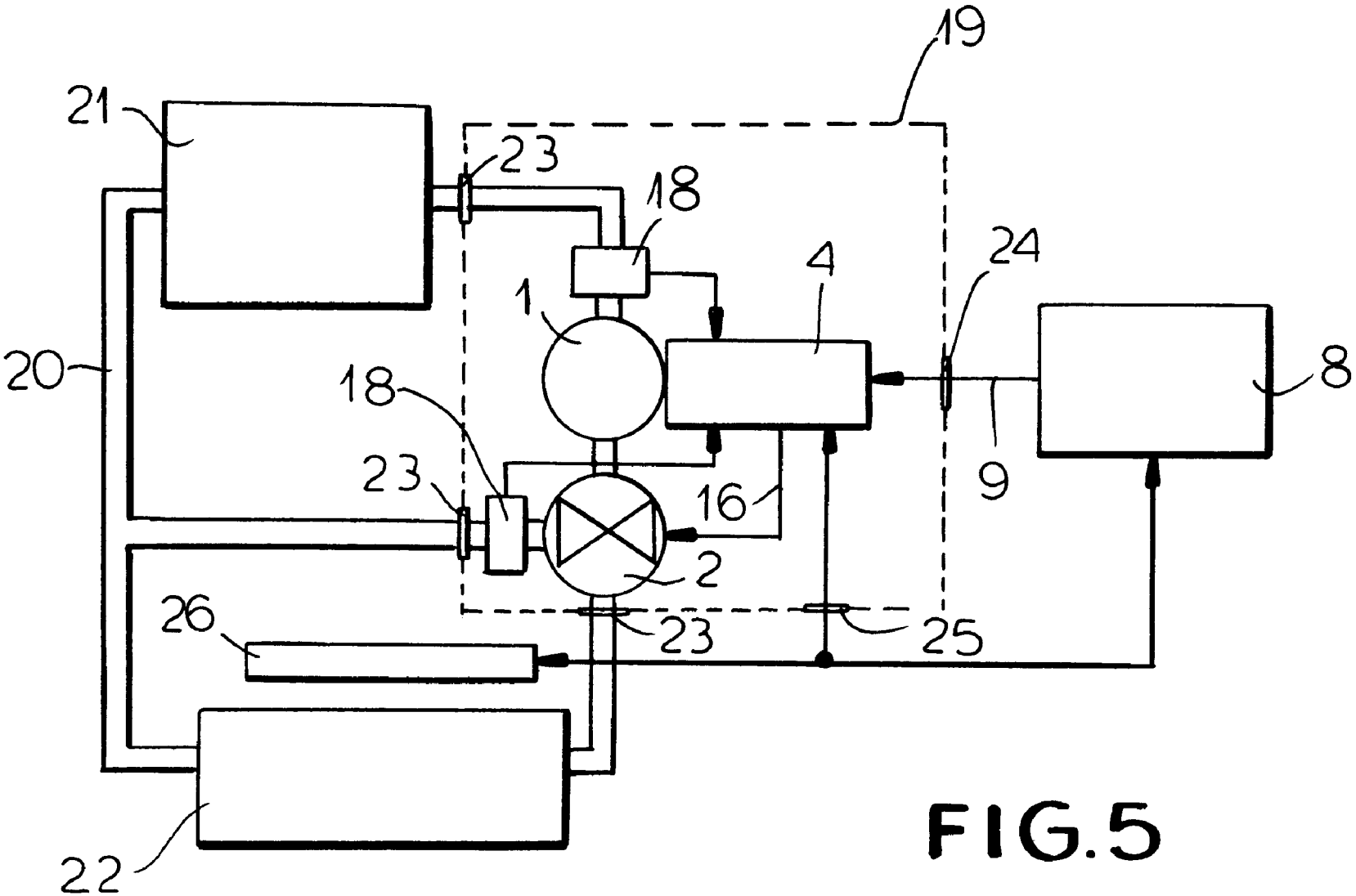
FIG. 5 is a schematic illustration of an apparatus according to the invention in a combustion engine of a motor vehicle.

In the embodiment of FIG. 5 the apparatus according to the invention is connected as a compact unit 19 to the coolant circuit 22 of a combustion engine 21 of a motor vehicle. The three-way valve 2 connects a conduit from a cooler 22 and a bypass for the cooler 22 together and back to the pump 1 which feeds the coolant back again to the combustion engine 21.

The unit 19 can be connected particularly quickly and simply via three hydraulic connections 23 to the coolant circuit 20 and via an electrical connector 24 to the separate master controller 8. If necessary further connections 25 for connection of further circuit elements, sensors 26, or control devices can be provided.

The master controller 8 is a motor-management unit by means of which for example instructions from the driver or from automatic control circuitry including the sensors 26 sets various operating parameters of the motor-vehicle engine 21. Thus for example the motor load can automatically be reduced when a maximum permissible high temperature is reached, in which case the apparatus according to the invention operates the pump 1 and valve 2 as needed.

What is claimed is:

1. A pumping apparatus comprising:

a pump connectable in a fluid path;

an electronically-controlled electric motor connected with said pump for controlling same;

a valve in said fluid path;

an electronically-controlled drive connected to said valve for controlling same;

an electronic pump controller connected to said electric motor and comprising a power circuit component, a processor component and a communication module component connectable with a master controller for operating said electric motor and said pump; and a valve controller for said drive and including at least one of said components of said pump controller, whereby said valve controller is at least partially integrated in said pump controller.

2. The apparatus defined in claim 1 wherein said valve controller is fully integrated in said pump controller and utilizes all of said components of said pump controller.

3. The apparatus defined in claim 1 wherein said valve controller has a separate power circuit for said drive and a separate processor for said drive and includes the communication module component of said pump controller.

4. The apparatus defined in claim 1 wherein said valve controller has a separate power circuit for said drive and utilizes the processor component and communication module component of said pump controller.

5. The apparatus defined in claim 1 wherein said valve controller includes a power circuit provided with an evaluating unit having at least one sensor selected from a temperature sensor, a flow sensor and a pressure sensor for a fluid displaced by said pump.

6. The apparatus defined in claim 1 wherein said valve is directly connected to and integrated into said pump.

7. The apparatus defined in claim 1 wherein the pump, the motor, said controllers, said valves and said drive form a module connected by two hydraulic connections to a liquid cooling system, of the combustion engine of a motor vehicle.

8. The apparatus defined in claim 1 wherein the pump, the motor, said controllers, said valves and said drive form a module connected by two hydraulic connections to a hot water circuit of a heating system.

* * * * *